US005181790A

United States Patent [19]

Lucas

[11] Patent Number: 5,181,790

[45] Date of Patent: Jan. 26, 1993

[54] DISPLAY AND APPLICATOR CONTAINER FOR WAXY PRODUCTS

[76] Inventor: Marthe Lucas, 22 allée des Fauvettes, 34280 La Grande Motte, Hérault, France

[21] Appl. No.: 796,446

[22] Filed: Nov. 22, 1991

[30] Foreign Application Priority Data

Nov. 30, 1990 [FR] France ..... 90 15039

[51] Int. Cl.[5] ..... A45D 40/04

[52] U.S. Cl. ..... 401/75; 401/68; 401/98; 401/175; 215/272

[58] Field of Search ..... 401/171-175, 401/68, 75, 78, 98, 73; 215/272; 220/281-283, 306, 326; 222/390

[56] References Cited

U.S. PATENT DOCUMENTS

| | | | |
|---|---|---|---|
| 3,175,853 | 3/1965 | Gilbertson | 220/326 X |
| 4,442,735 | 4/1984 | Chance et al. | 215/272 X |
| 4,605,330 | 8/1986 | Crowley et al. | 401/175 X |
| 4,702,399 | 10/1987 | Davis | 401/175 X |
| 4,781,483 | 11/1988 | Lorscheidt | 401/98 X |
| 4,844,269 | 7/1989 | Lucas . | |
| 4,915,528 | 4/1990 | Seager | 401/175 X |
| 4,950,094 | 8/1990 | Yorks . | |
| 5,000,600 | 3/1991 | Cardia et al. | 401/175 X |
| 5,076,720 | 12/1991 | Roger | 401/68 X |

FOREIGN PATENT DOCUMENTS

| | | | |
|---|---|---|---|
| 70257 | 1/1983 | European Pat. Off. | 401/175 |
| 265329 | 4/1988 | European Pat. Off. . | |
| 2651869 | 5/1978 | Fed. Rep. of Germany . | |
| 2807472 | 8/1979 | Fed. Rep. of Germany | 401/175 |

*Primary Examiner*—Danton D. DeMille
*Attorney, Agent, or Firm*—Larson & Taylor

[57] ABSTRACT

The display and applicator container for waxy products comprise a body of substantially oval shape in cross-section and having a bearing surface, and a cap having to be tightly closed and containing a sealing gasket in correspondence with the bearing surface of the body. The sealing gasket is made by a cover fitted inside the cap by centering and latching members. The cover defines an annular housing fitting over a lip of the body, and formed from an inner rib defined by a tapered inner wall of the cover. The body contains an apertured piston and has a bottom defining an open sheath for introduction in liquid form of a waxy material through the apertured piston so as to be moulded as a cake. The open sheath is closed by a driving member for the piston.

13 Claims, 4 Drawing Sheets

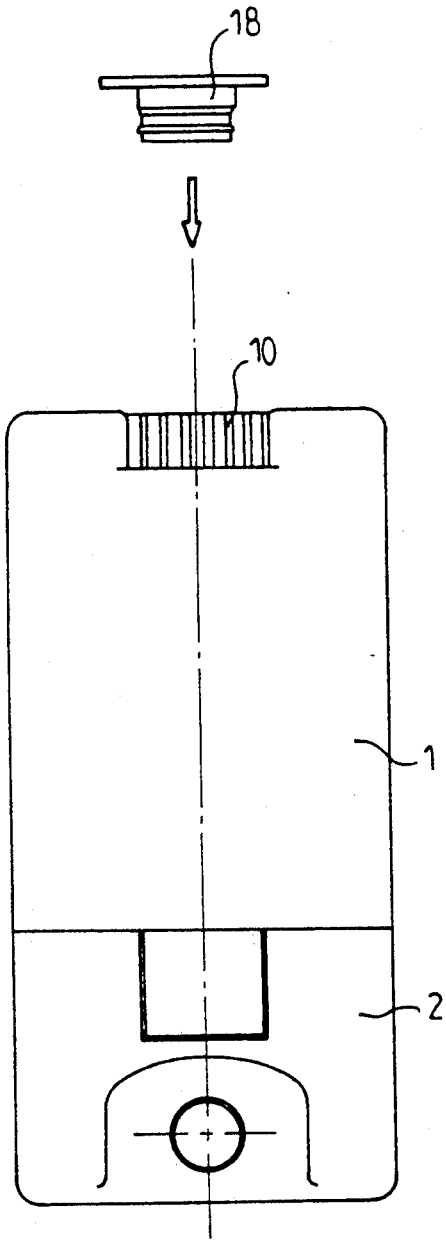
FIG. 1
FIG. 2
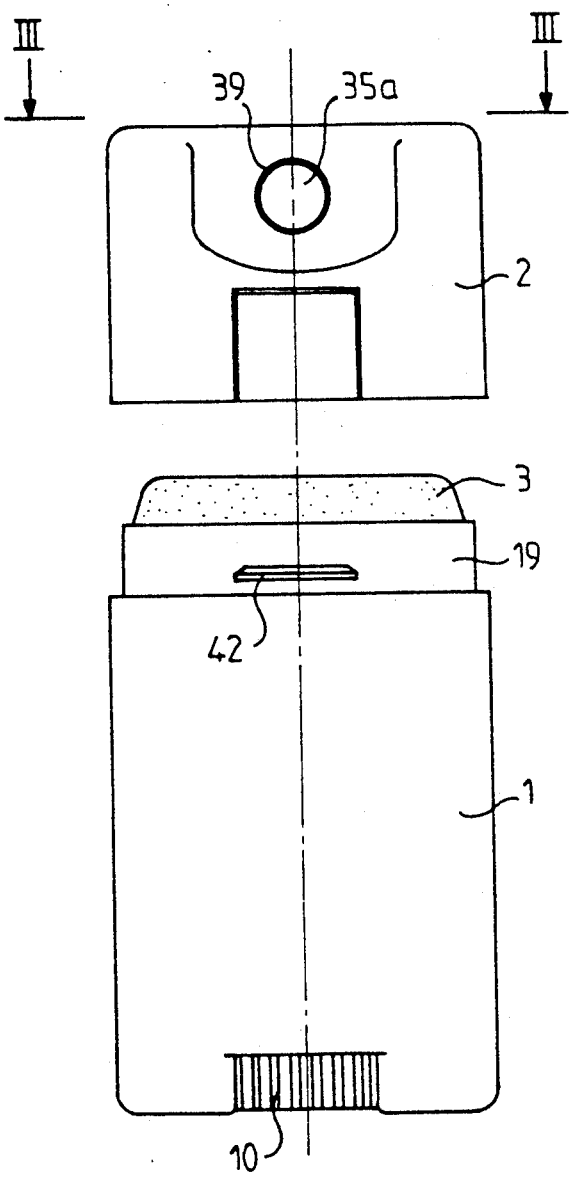
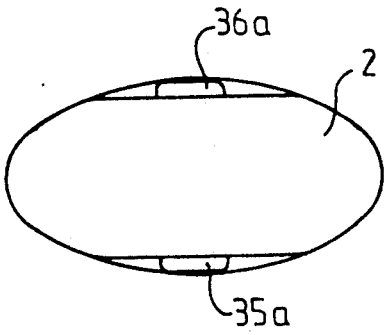
FIG. 3

DISPLAY AND APPLICATOR CONTAINER FOR WAXY PRODUCTS

BACKGROUND OF THE INVENTION

1. Field of the Invention

The present invention relates to a display and applicator container for waxy products, which are solid at room temperature, for example waxy products such as cosmetic products of the deodorant type, household products such as shoe polish, wax and the like.

Some of the above waxy products contain volatile agents and, consequently, the container has to ensure their preservation, i.e. to avoid that these volatile agents will come in contact with the ambient atmosphere during the storage or placement of the container.

2. Brief Description of Prior Art

The applicant has already disclosed a packing device with an oval shape in section and comprising a cap of same shape for such waxy products.

This packing device is typically disclosed in U.S. Pat. No. 4,844,269 to Lucas.

In the above mentioned packing device, there is provided a cap comprising a lid with a sealing gasket, corresponding to a bearing surface of the body of the packing device, which body forms lateral studs cooperating with bearing surfaces defined by lugs of the cap so that the sealing gasket is compressed on the bearing surface. The sealing gasket is preferably formed as a single piece.

The device according to the above patent makes possible to disengage the lid by first turning it so that it will escape from retaining abutments. In a variant of embodiment, the lid is latched by legs of a yoke which extends into a latching groove.

OBJECT OF THE PRESENT INVENTION

It is an object of the present invention to provide a device of the above type but in which the tightness of a portion of the packing device which contains the active product is improved. The packing device of the invention makes it impossible to easily displace the active product by preventing the same to adhere to the walls of the body containing the active product and preventing air to be compressed during the closing operation and preventing, likewise, to create a void, even a partial void, upon opening the packing device.

SUMMARY OF THE INVENTION

According to the invention, the display and applicator container for waxy products, solid at room temperature, comprises a body of a substantially oval shape in cross-section and having a bearing surface, and a cap which has to be tightly closed and containing a sealing gasket in correspondence with the bearing surface of the body;

wherein the sealing gasket is made by a cover fitted inside the cap by centering and latching means;

wherein the cover defines an annular housing fitting over a lip of the body, this annular housing being formed from an inner rib defined by a tapered inner wall of the cover;

wherein the body contains an apertured piston and has a bottom defining an open sheath for introduction in liquid form of a waxy material through the apertured piston so as to be moulded as a cake by said body against the inner wall thereof and against the cover whereby forming a mold;

wherein the open sheath is closed by a driving member for the apertured piston, whereby the waxy material of the cake is isolated from ambient atmosphere by the cover of the cap and the driving member.

Various other features of the invention will become more apparent from the following detailed description.

BRIEF DESCRIPTION OF THE DRAWINGS

Embodiments of the invention are shown, by way of non limiting examples, in the accompanying drawings, in which:

FIG. 1 is a partly broken an elevation view of the display and applicator container of the invention, in its turned over filing position;

FIG. 2 is an exploded elevation view of the display and applicator container of the invention, ready for being used;

FIG. 3 is a top view taken along line III—III of FIG. 2;

DESCRIPTION OF PREFERRED EMBODIMENTS

Figure 6:
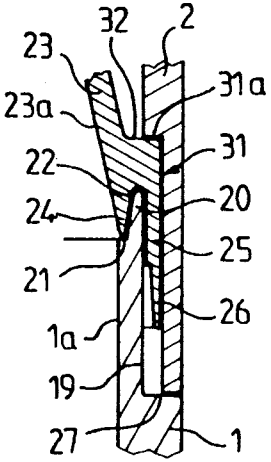
FIG. 6 is an enlarged partial cross-sectional view of the detail A shown in FIG. 4.

The display and applicator container shown in the drawings comprises a body 1, for example of an oval section, which is covered by a cap 2.

The body 1 is intended for containing a cake 3 of a rigid waxy product, for example a deodorant product, a shoe-polish or the like, which can contain volatile products, for example alcoholic compounds, and which has therefore to be completely isolated from the ambient atmosphere when not in use.

Figure 5:
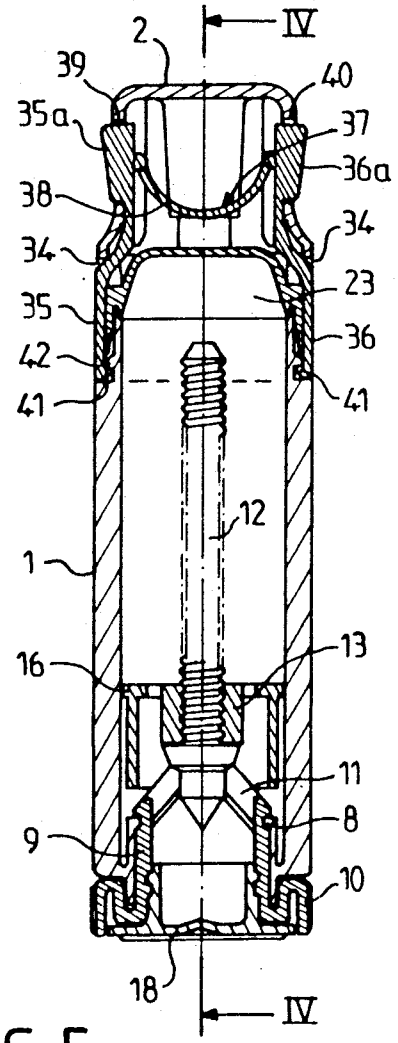
FIG. 5 is a cross-sectional view taken along line V—V of FIG. 4.
Figure 4:
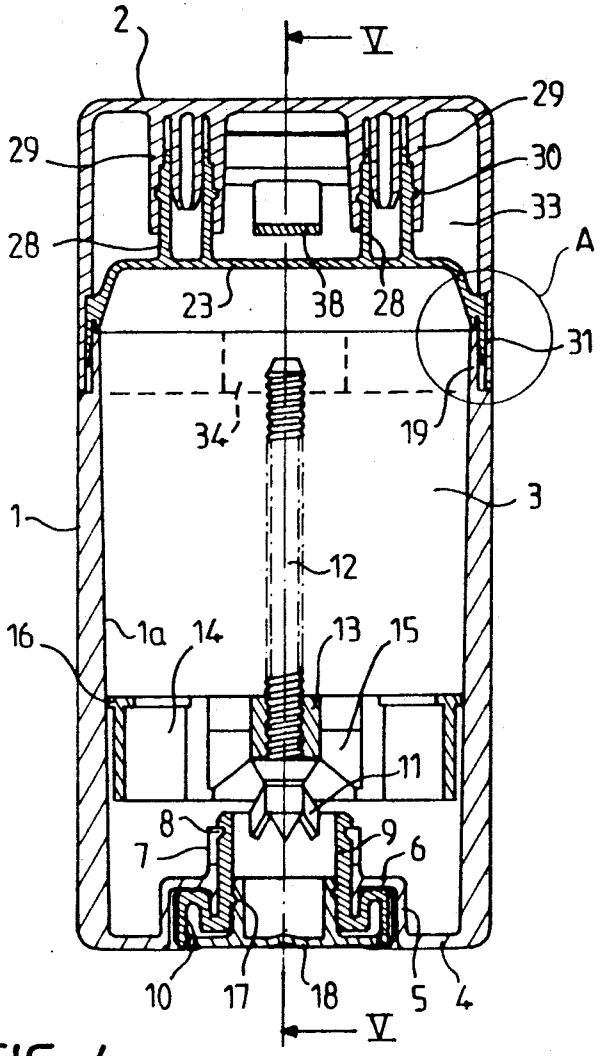
FIG. 4 is a cross-sectional view of the display and applicator container of the invention, taken along line IV—IV of FIG. 5.

As better shown in FIGS. 4 and 5, the body 1 has a bottom 4 with an annular re-entrant edge 5 having a diameter which corresponds substantially to its width.

The edge 5 is connected via a web to a sheath 7 forming a retainer ring 8.

The retainer ring 8 maintains a sheath 9 of a knurled knob 10 which is housed inside the re-entrant edge 5 so as to protrude only on the flank of the body 1.

The foregoing description shows that the knurled knob 10 can freely rotate when operated, for example by two fingers of one hand, without having a possibility to slide axially.

The knurled knob 10 can be put in position by being encased in the sheath 7 and snapped-in at end of its stroke by the retainer ring 8.

The sheath 9 of the knurled knob 10 comprises wings 11 supporting a screw 12 provided to extend inside the body 1. The screw 12 is screwed within an inner thread 13 of a piston 14.

Figure 8:
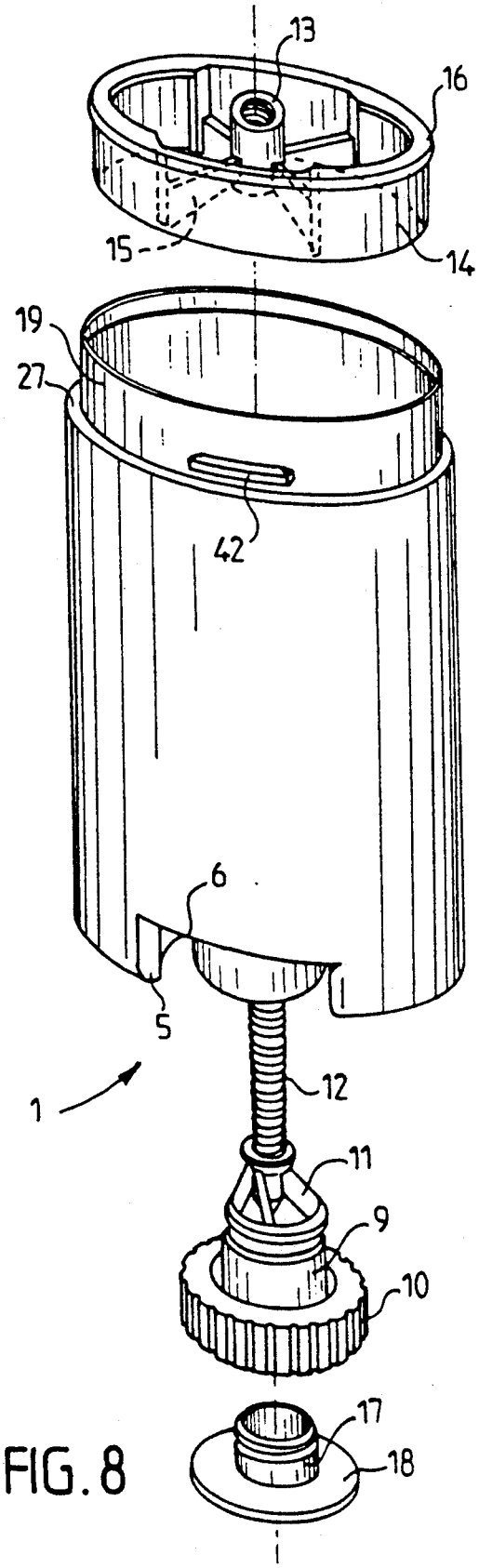
FIG. 8 is an exploded perspective view of the body of the container of the preceding figures.

The drawings, and in particular FIGS. 4 and 8, show that the piston 14 is apertured as at 15.

Preferably, a scratching edge 16 is formed on a periphery of the apertured piston 14 so as to bear against an inner wall 1*a* of the body 1, this being shown particularly in FIGS. 4 and 5.

An inside of the sheath 9 comprises a second retainer ring 17 for retaining a plug 18 forming a bottom for the knurled knob 10 while ensuring also tightness of the latter, whose cooperation with the sheath 7 will ensure tightness with the body 1.

As shown in FIG. 4, it is advantageous that the wall 1*a* of the body 1 has a slight taper, at least on a portion of its periphery.

At the end which is opposite to the bottom 4, the body 1 is formed with a skiving 19 from its outer wall, and the outer edge of the body 1 forms a lip 20 (FIG. 6) which, with the inner wall 1*a*, defines a shoulder 21.

The lip 20 is intended for being fitted inside an annular housing 22 of a cover 23.

FIG. 6 shows that the annular housing 23 is defined by an inner rib 24 and an outer web 25 of the cover 23.

The web 25 is advantageously formed with a step portion 26 in its inner portion.

The hereabove described unit is such that the tapered inner wall 1*a* of the body 1 and the tapered inner wall 23*a* of the cover 23 are in the prolongation of each other without practically any discontinuity when the cover 23 is put in position so that the annular housing 22 will fit over the lip 20 and the outer web 25 will extend outside the skived portion 19 which protrudes beyond a shoulder 27 of the body 1. Moreover, the above described unit ensures a total tightness between the body 1 and cover 23 whose walls are continuous.

The cover 23 has a top portion provided with sheaths 28, for example two in number, which are engaged inside muffs 29 of the cap 2. The sheaths 28 are latched inside the muff 29, for example by means of retainer rings 30.

The cap 2 has an inner side wall formed with a clearance 31 for centering the cover 23, one shoulder 32 (FIG. 6) of which is in abutment against a bottom 31*a* of the clearance 31.

The cover 23 is, in this manner, rigidly connected to the cap 2, and its outer web 25 is pressed by the cap 2 against the skiving 19 of the body 1, which ensures an absolute tightness.

The step portion 26 provided at the base of the outer web 25, is such that air is progressively expelled when the cap 2 is set in position on the body 1, even when the body 1 is filled with the cake 3.

As shown in the following description, it is moreover possible to form, in the outer web 25, at least one small inner groove extending up the vicinity of the top of the lip 20, so as to allow an escapement of air until the body 1 is completely closed.

Conformation of the cover 23, at least in its inner wall, is made with a relief corresponding to the appearance desired to be given to the top of the cake 3. Thus, with reference to FIG. 1, when the cap 2, provided with its cover 23, is in position, the inside of the body 1 forms a mould in which the waxy material, having to form the cake 3, can be poured after having been made fluid, for example by heating it.

The waxy material, which is then in a more or less viscous liquid form, will flow through the apertures 15 of the piston 14, and will fill progressively the inside of the body 1, while accurately taking its shape.

At end of the filling operation, the plug 18 of the knurled knob 10 is put in position, so that the cake 3 formed and cooled inside the body 1 of the cover 23 is perfectly isolated from the ambient atmosphere.

In order to use the constituent material of the cake 3, it suffices to remove the cap 2, by which the cake 3 comes into sight as shown in FIG. 2.

When the protruding portion of the cake 3 is partly used or when it is desired that a more important height of the cake 3 will project form the body 1, the knurled knob 10 is rotated, the effect of which is that the screw 12 will move the piston 14 which pushes the cake 3.

The very slight taper which is formed in the inner wall 1*a* of the body 1 facilitates a displacement of the cake 3 when pushed by the piston 4, and this taper provides that ambient atmospheric air will flow along the cake 3 and come below the piston 14, the scraping edge 16 of which being then very slightly spaced apart from the inner wall 1*a*, at least over a portion of the surface thereof.

Likewise, when the knurled knob 10 is rotated in the direction in which the cake 3 is again returned within the body 1, the very small space which is left between its outer wall and the inner wall 10 of the body 1 enables the air which is underneath the piston 4 to escape without being compressed against the bottom 4 of the body 1.

Various means can be used for maintaining the cap 2 in position on the body 1.

Figure 7:
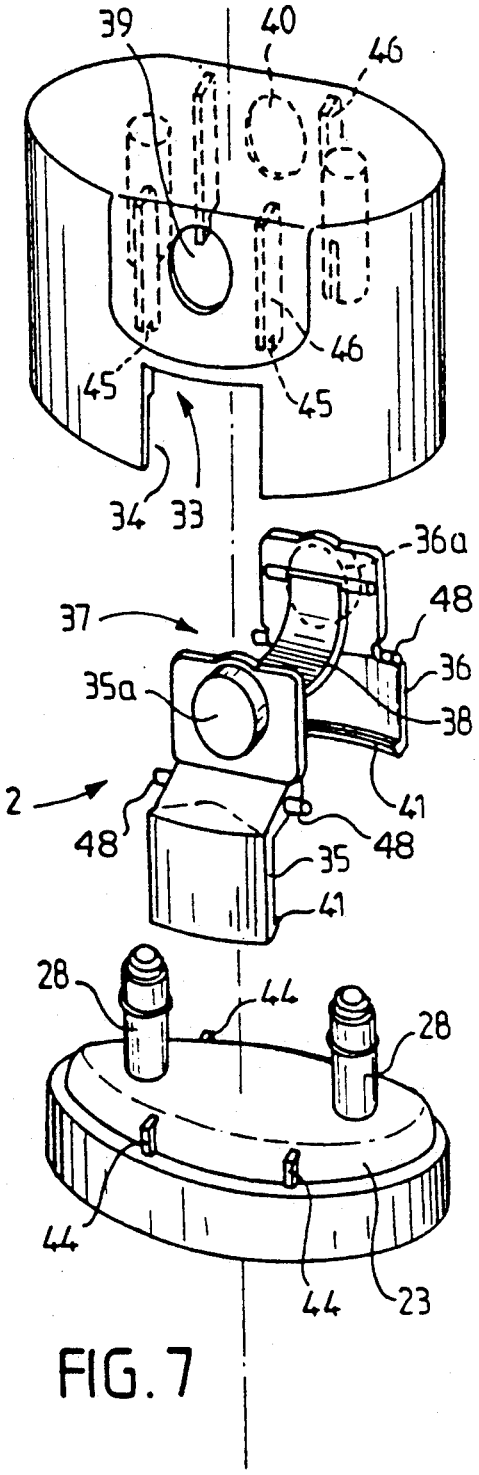
FIG. 7 is an exploded perspective view of a cap of the container of the preceding figures.

In the embodiment according to FIGS. 1 to 5, the cap 2 defines above the cover 23 a chamber 33 and is formed in its wall with notches 34 for legs 35 and 36 of a yoke 37, which is better shown in FIG. 7, the bottom 38 of which yoke 37 is curved or conformed in any other manner so as to be resiliently deformable.

The legs 35 and 36 of the yoke 37 have substantially the shape of a letter S (see FIGS. 5 and 7) and are provided with buttons 35*a* and 36*a* protruding through holes 39, 40 opening from the cap above the notches 34.

Ends of the legs 35 and 36 form small bars 41 engaged underneath corresponding ribs 42 of the body 1.

As illustrated in FIGS. 5 and 7, by exerting a pressure on the buttons 35*a* and 36*a*, the bottom 38 will bend while moving the small bars 41 away from each other so as to enable a disengagement of the cap 2, which can be put back in position simply by pushing it, the small bars 41 being then spaced apart by the ribs 42.

Figure 9:
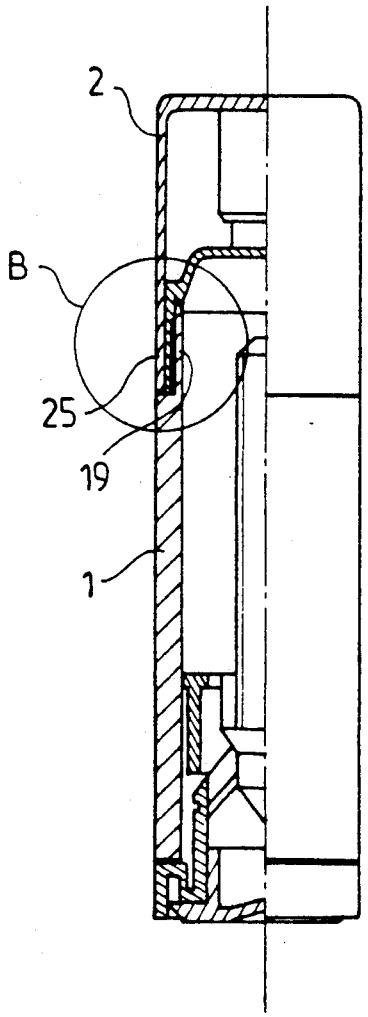
FIG. 9 is a cross-sectional view, similar to FIG. 5, of an alternative embodiment.
Figure 10:
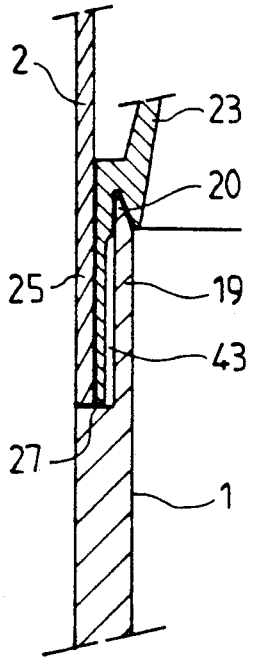
FIG. 10 is an enlarged cross-sectional view of the detail B shown in FIG. 9.

FIGS. 9 and 10 show an alternative mode of fixation of the cap 2 on the body 1.

In this embodiment, the height of the skiving 19 of the body 1 is calculated, taking into account the material forming the body 1 and the material forming the cover 23, so that the friction exerted by the outer web 25 on the outer wall of the skiving 19 is sufficient for retaining the cap 2 in position.

FIG. 10 shows that in order to increase the friction, it is advantageous that the outer web 25 is prolongated so as to bear against the shoulder 27 of the body 1 when the lip 20 is completely engaged in the annular housing 22.

In order that air, which can be possibly trapped between the cap 2, the body 1 and the cake 3, can espace when the cap 2 is put in position, it is advantageous, as shown in FIG. 10, to provide at least one groove 43 in the skiving 19 or in the outer web 25, the groove 43 extending up to the vicinity of the lip 20.

In this embodiment, it is not necessary to provide the yoke 37 nor the particular arrangement formed by the notches 34 and the holes 39, 40 of the cap 2.

In order to further improve holding of the cap 2 on the body 1, in the embodiment shown with reference to FIGS. 9 and 10, it is advantageous that the outer wall of the skiving 19 and/or the inner wall of the outer web 25 will be ground or made rough in any other manner. A slow ageing adhesive material can also be deposited on the whole or part of the surface of the skiving 19 or of the outer web 25; a slow ageing adhesive material or another permanent adhesive element of any type known in the art can also be provided on the shoulder 27 so as to ensure a suitable holding of the cap 2.

In addition to the foregoing and so as to be certain that the cover 23 is always brought in a perfectly accurate way on the lip 20 by the cap 2, it is advantageous as shown in FIG. 7 that the cover 23 will be formed on the top thereof with studs 44 centered in notches 45 of protrusions 46, formed inside the cap 2.

In this manner, the yoke 37 is provided with pivot pins 48 which are trapped inside the notches 45 and latched by the studs 44 while being able to pivot when a pressure is exerted on the buttons 35, 35*a* so as to cause a spacing of the small bars 41.

The invention is not restricted to the embodiments shown and described in detail and various modifications thereof can be carried out thereto without departing from the scope of the accompanying claims.

What is claimed is:

1. A display and applicator container for waxy products which are solid at room temperature comprising:

(i) a body of substantially oval shape in cross-section comprising:

a bearing surface;

an aperatured piston contained in said body;

a bottom;

an open sheath defined by said bottom for introduction of a waxy material through said aperatured piston, whereby said waxy material is molded into a cake against an inner wall of said body and a cover;

a cover; and a driving member for said aperatured piston, said open sheath is closed by said driving member and said waxy material is isolated from ambient atmosphere by said cover and said driving member;

(ii) a cap capable of being tightly closed comprising: fixation members comprised of a yoke having a resiliently deformable bottom, and legs having operating buttons and small bars formed by ends thereof, said body including ribs which cooperate with said small bars for securing the cap on the body said cover fitted inside said cap by centering and latching means;

(iii) a sealing gasket, formed by said cover and being in correspondence with said bearing surface of said body; and (iv) an annular housing defined by said cover and formed from an inner rib and fitting over a lip of said body, said inner rib being defined by a tapered inner wall of said cover.

2. The container as set forth in claim 1, wherein control means are provided for controlling the apertured piston, said control means comprising a knurled knob engaged inside a re-entrant edge of said bottom of said body and connected thereto by said open sheath, whereby said aperture piston is guided during rotation.

3. The container as set forth in claim 2, wherein said knurled knob is hollow and closed by a removable plug, and wherein said apertured piston is formed with apertures, whereby said waxy material in a liquid form may flow therethrough to progressively fill the inside of said body.

4. The container as set forth in claim 2, wherein said apertured piston has an inner thread, said knurled knob being connected by wings to a screw screwed inside said inner thread.

5. The container as set forth in claim 1, wherein said inner wall comprises at least a portion formed with a slight taper.

6. The container as set forth in claim 1, wherein said body has a skiving, and wherein said cover defines an outer web pressed against a surface of said skiving by the cap in which said cover is fitted.

7. The container as set forth in claim 1, wherein said cover is centered inside said cap by said ribs, and is latched in said cap by sheath and muff means.

8. The container as set forth in claim 1, wherein said apertured piston has a periphery, said periphery being provided with a scraping edge.

9. The container as set forth in claim 1, wherein said cover is formed with means for discharge and admission of air between said cake and a bottom of said cover.

10. The container as set forth in claim 1, wherein said cap is insidely provided with protrusions having notches, and wherein said yoke comprises lateral pivot pins articulated inside said notches, said cover carrying a set of studs for closing said notches, said lateral pivot pins being retained by said studs.

11. The container as set forth in claim 1, wherein said cap is held by friction on said body.

12. The container as set forth in claim 1, wherein said body has a skiving, and wherein, said cover is formed with an outer web extending over an entire height of said skiving to maintain said cap on said body, said outer web being formed with at least one groove for circulation of air and being clamped by friction onto said body by said cap.

13. The container as set forth in claim 1, wherein slow ageing adhesive means are interposed between said cap and said body.

* * * * *